US007916019B2

(12) United States Patent
Vial et al.

(10) Patent No.: US 7,916,019 B2
(45) Date of Patent: Mar. 29, 2011

(54) DEVICE FOR DETECTING THE RELATIVE POSITION OF TWO ELEMENTS VIA ELECTRIC CIRCUIT SECTION HAVING MECHANICAL FUNCTION IN AT LEAST ONE OF THE ELEMENTS

(75) Inventors: Franck Vial, Paladru (FR); Laurent Jouanet, Autrans (FR); Marc Beranger, St Martin d'Uriage (FR); Roland Blanpain, Entre-Deux-Guiers (FR); Gerard Evreux, Ayze (FR); Dominique Jacquin, Carspach (FR)

(73) Assignee: Commissariat A l'Energie Atomique, Etablissement Public A Caractere Industriel Et Commercial, Paris (FR)

( * ) Notice: Subject to any disclaimer, the term of this patent is extended or adjusted under 35 U.S.C. 154(b) by 471 days.

(21) Appl. No.: 11/874,403

(22) Filed: Oct. 18, 2007

(65) Prior Publication Data

US 2008/0094239 A1 Apr. 24, 2008

(30) Foreign Application Priority Data

Oct. 19, 2006 (FR) ..... 06 54361

(51) Int. Cl.
*G08B 13/08* (2006.01)

(52) U.S. Cl. ..... 340/545.1; 340/540; 340/541; 340/545.4; 340/687; 340/691.1

(58) Field of Classification Search ..... 340/686.1, 340/545.1, 551, 552, 561, 540, 541, 545.4, 340/687, 691.4
See application file for complete search history.

(56) References Cited

U.S. PATENT DOCUMENTS

| | | | | |
|---|---|---|---|---|
| 1,738,508 | A | 12/1929 | Bonnell | |
| 1,827,366 | A * | 10/1931 | Kertz | 340/545.1 |
| 2,281,193 | A * | 4/1942 | Hollingsworth | 200/61.8 |
| 2,592,660 | A * | 4/1952 | Crumley | 200/318.2 |
| 2,615,083 | A * | 10/1952 | Krueger | 340/426.28 |
| 3,051,935 | A * | 8/1962 | Willson | 340/550 |
| 3,147,468 | A * | 9/1964 | Daniels | 340/542 |
| 3,161,742 | A * | 12/1964 | Bagno | 335/208 |
| 3,263,040 | A * | 7/1966 | Bliven | 200/61.64 |

(Continued)

FOREIGN PATENT DOCUMENTS

DE 219704 C 3/1910

(Continued)

OTHER PUBLICATIONS

Search Report dated May 23, 2007 in Corresponding French Patent Application No. 0654361.

(Continued)

*Primary Examiner* — Daniel Wu
*Assistant Examiner* — Son M Tang
(74) *Attorney, Agent, or Firm* — Westerman, Hattori, Daniels & Adrian, LLP

(57) ABSTRACT

The main object of the present invention is a device for detecting a relative position of a first element (12, 14) having a main mechanical function and a second element, including an electric circuit (4) the opening and closing of which respectively correspond to a first and a second position of the first and second elements with respect to each other, wherein at least the first element is part of the electric circuit (4).
An object of the present invention is also a monitoring installation comprising such detecting devices.

19 Claims, 6 Drawing Sheets

U.S. PATENT DOCUMENTS

| | | | | | |
|---|---|---|---|---|---|
| 3,426,166 | A * | 2/1969 | Canceill | 200/61.62 |
| 3,604,984 | A * | 9/1971 | Andreassen | 361/829 |
| 3,653,022 | A * | 3/1972 | Tall | 340/545.1 |
| 3,838,234 | A * | 9/1974 | Peterson | 200/61.7 |
| 3,924,256 | A * | 12/1975 | Cohen | 340/508 |
| 3,967,478 | A * | 7/1976 | Guinn | 70/144 |
| 3,968,337 | A * | 7/1976 | Cole | 200/61.62 |
| 4,030,089 | A * | 6/1977 | Wurfel | 340/550 |
| 4,143,367 | A * | 3/1979 | Schestag | 340/540 |
| 4,178,588 | A * | 12/1979 | Queren | 340/542 |
| 4,415,893 | A * | 11/1983 | Roland et al. | 340/5.33 |
| 4,516,114 | A * | 5/1985 | Cook | 340/542 |
| 4,556,765 | A * | 12/1985 | Shaw et al. | 200/61.71 |
| 4,679,881 | A * | 7/1987 | Galvin et al. | 439/392 |
| 4,814,750 | A * | 3/1989 | Abramson | 340/550 |
| 5,063,372 | A * | 11/1991 | Gillett | 340/547 |
| 5,406,263 | A * | 4/1995 | Tuttle | 340/572.1 |
| 5,914,658 | A | 6/1999 | Arakawa | |
| 6,447,139 | B1 * | 9/2002 | Wilkes | 362/100 |
| 6,950,033 | B1 * | 9/2005 | Guyre | 340/687 |
| 7,049,914 | B2 * | 5/2006 | Lamb et al. | 335/216 |
| 7,242,297 | B2 * | 7/2007 | Vogt | 340/547 |
| 2005/0152142 | A1 * | 7/2005 | Traynor | 362/249 |
| 2005/0248466 | A1 * | 11/2005 | Ghazarian et al. | 340/686.1 |

FOREIGN PATENT DOCUMENTS

| | | | |
|---|---|---|---|
| DE | 8911033 | U1 | 2/1990 |
| DE | 20220357 | U1 | 8/2003 |
| EP | 0 582 733 | A1 | 2/1994 |
| EP | 1 014 322 | A1 | 6/2000 |
| EP | 1 034 727 | A1 | 9/2000 |
| GB | 1 414 982 | A | 11/1975 |

OTHER PUBLICATIONS

Search Report dated May 23, 2007 in Corresponding French Patent Application No. 0654361 (with partial translation).

* cited by examiner

DEVICE FOR DETECTING THE RELATIVE POSITION OF TWO ELEMENTS VIA ELECTRIC CIRCUIT SECTION HAVING MECHANICAL FUNCTION IN AT LEAST ONE OF THE ELEMENTS

1. TECHNICAL FIELD

The present invention refers to a device for detecting the position of two movable components relative to each other the integration of which is improved, in particular a sensor to be implemented in assistance or monitoring devices, of the alarm type.

2. PRIOR ART

The devices for detecting or sensing a relative position of two elements of a known type are interposed between the two elements and detect a modification of the parameters of the environment, for example due to a displacement of a movable part in the sensor. In the case of a refrigerator, the opening of the door causes the illumination of the lamp which is arranged inside the refrigerator. In this case, the sensor is formed by a stud maintained into contact with the door by a spring. The displacement of this stud causes, when the door is closed, the opening of the electric-power supply circuit of the lamp. When opening the door, the stud moves into the opposite position, causing the closing of the electric circuit and the electric-current supply to the lamp and its lighting. The electric circuit is inserted against the structure of the refrigerator.

EP 1 014 322 B1 discloses a burglar-proof device for a roller shutter closing an opening. This device includes a sensor on the lower blade of the shutter aimed at informing about the position of the lower blade with respect to the lower frame of the shutter. This sensor is formed by a stud protruding with respect to the lower blade. The latter, when the roller shutter is closed, is into contact with the lower frame of the opening. The stud then adopts an inserted position, and no information is sent by radio wave to a radio-frequency receiver.

In the event of breaking-in, i.e. when the roller shutter is lifted, the lower blade is then separated from the lower edge of the opening, and the stud is no longer in an inserted position. This change in position of the stud causes a radio-frequency signal to be transmitted by a transmitter to the radio-frequency receiver, and for example an alarm to be activated. The transmitter is inserted against the roller shutter.

These detecting devices have the drawback of requiring to be inserted against at least one of the elements a relative displacement of which one wants to detect, or close to the latter. This addition can sometimes be complex, unaesthetic and increase the cost price of the structure.

SUMMARY OF THE INVENTION

It is therefore an object of this invention to provide a detecting device integrated into the system that is provided with same, without disturbing its operation and without deteriorating its outer aspect in a substantial way.

The above-mentioned object is achieved by a device for detecting the relative position of two elements, one of the two elements fully ensuring a mechanical function, the device including at least one of the elements.

In other words, at least one of the elements the position of which with respect to the other element one wants to detect is used to transmit the information about the nearing or the separation of the two elements, while this element ensures its mechanical function.

To this end, the sensor according to the present invention includes an electric circuit capable of being opened and closed according to the position of the two elements, at least one of the elements being an electrically conductive part being part of an electric circuit, the nearing or the separation of the other element causing an electric circuit to close or to open.

The present invention has the advantage of providing a very robust detecting device, since it is not inserted against the device that is provided with it, but integrated at least partly into one of the elements the relative position of which one wants to detect.

Therefore, the present invention has mainly as an object a device for detecting a relative position of a first element, having a main mechanical function, and of a second element, including an electric circuit the opening and closing of which respectively correspond to a first and a second position of the first and second elements with respect to each other, wherein at least the first element is part of the electric circuit.

In the present application, by "element having a first main mechanical function" is understood an element that ensures any mechanical function. This can be, for example, a supporting function in the case of a door-frame, of seizing function, in particular in the case of a door handle, a suspension or coupling function, for example in the case of means for coupling an object. The above-mentioned list is not exhaustive, it can also relate to a supporting element, such as a support arm, cleats, etc.

In the present application, by first position and second position is also understood a relative arrangement and another relative arrangement, whereby each one of these relative arrangements is not necessarily unique. For example, in the case of a door, the first position can correspond to the fully closed position, in which the leaf is flush with the sash-frame and the second position corresponds to the open position, this open position including all the positions of the leaf of the door with respect to the sash-frame of the door, from slightly opened to wide open. Thus, the second position actually includes a plurality of positions of the leaf with respect to the sash-frame.

It could also been foreseen that the closed position of a door corresponds to a minimum closing threshold, for example in the case of a roller shutter. It could be considered that the roller shutter is in closed position when it closes the opening to the extent of ¾ or ⅘.

Thus, the first element, in addition to ensuring its first mechanical function, ensures the additional function of transmitting information to a device for detecting the relative position of this first element with respect to the second element. This second element can ensure a mechanical function identical to that of the first element, for example in the case of a handle comprised of a first element and a second element. The second element can also ensure a function complementary to that of the first element, for example in the event the first element is a sash-frame of a door and the second element is a leaf of the door.

According to the invention, the first element can include two electrically isolated conductive parts.

The device according to the invention can be used for detecting an opening or closing of a door or a window. The first element can then be a sash-frame of a door or window, and the second element can be a leaf of a door or window, respectively.

The sash-frame of a door can advantageously include an electrically conducting outer frame and an electrically conductive inner frame, said outer and inner frames forming said conductive parts, at least one of the frames including an electric discontinuity capable of being filled with an electrically conductive movable part in order to close the electric circuit, said movable part being either carried by the leaf, or arranged in the discontinuity and bringing into contact portions on both sides of the discontinuity during the nearing or the separation of the leaf.

The electrically conductive movable part is for example T-shaped, the arms of the T being each aimed at entering into contact with portions on both sides of the discontinuity and the foot of the T acting as actuation means aimed at entering into contact with the leaf, the closing of the door causing a separation of the legs of the T from the portions on both sides of the discontinuity.

The electrically conductive movable part can also be formed by a movable keeper capable of being displaced by a bolt.

Diode-type illumination means capable of lighting when the electric circuit is closed can also be provided for, mounted between the inner frame and the outer frame.

An object of the present invention is also a monitoring installation, including several detecting devices according to the present invention, electrically connected in series.

The first elements of each device can then be electrically connected by plinths.

An object of the present invention is also a device for detecting the presence or absence of an object, the first element forming a support for coupling a suspension arm for said object.

The two electrically conductive parts are then capable of being electrically connected in order to close the electric circuit by the second element formed by an electrically conductive plunger movable through applying a load on the suspension arm.

The load is, for example, transmitted by the suspension arm to the plunger.

The two electrically conductive parts can be formed by profile bars or cables capable of permitting the suspension and the monitoring of several objects.

If the electrically conductive parts are formed by profile bars, a first profile bar includes a tube with a rectangular cross-section provided, on one face, with a groove, a second profile bar includes a tube with rectangular cross-section provided, on one face, with a groove, the two grooves being arranged in front of each other, an electrically insulating material being arranged between the two faces of the tubes including the grooves, the second tube including, on a face opposite the face including the groove, holes for the passing-through of a load-transmitting finger, the movable probe being movably fitted perpendicular to the axis of the tube, a base of the plunger being mounted in the tube of a first element, a probe of the plunger being mounted in the tube of the second element, said probe being in front of a passageway for the finger, the probe being elastically restored towards the passageway for the finger.

An object of the present invention is also a monitoring installation, wherein the first element of the device according to the present invention forms a cornice extending along at least part of a wall allowing fixing several objects next to each other and their monitoring.

The first and the second element are, for example, two portions of a handle for opening a leaf, said portions being made out of electrically conductive materials, the actuation of the handle causing the first and second elements to be brought into electrical contact and means for assisting the opening to be activated.

The two elements of the handle advantageously include an elongated portion with a protrusion in the median portion, the two protrusions being in front of each other and aimed at entering into contact, springy means maintaining the two protrusions separated from each other in resting position.

The assisting means can be of the electric motor type.

BRIEF DESCRIPTION OF THE DRAWINGS

The present invention will be better understood by means of the following description and of the attached drawings, in which.

DETAILED PRESENTATION OF PARTICULAR EMBODIMENTS

Figure 1:
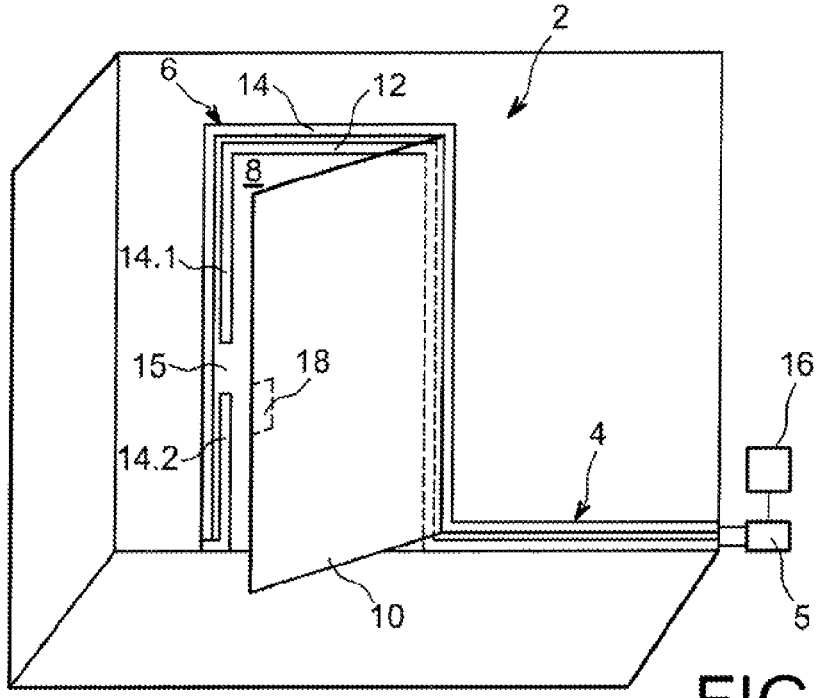
FIG. 1 is a schematic representation of a first embodiment of a detecting device according to the present invention applied to the control of the closing of a door.

In FIG. 1, one can see a first exemplary embodiment of a detecting device according to the present invention for allowing detecting the opening and closing of a door 2.

According to the present invention, the detecting device includes an electric circuit 4 capable of being closed when closing the door 2 and of being opened when opening the door 2, the opening and closing of the circuit being processed by a data-processing unit 5 that, depending on the passing-through or not of current, emits an information signal related to the closing or opening of the door.

The door 2 includes a sash-frame 6 delimiting an opening 8 and a leaf 10 aimed at being applied against the sash-frame 6 in order to close the opening 8.

According to the present invention, the sash-frame 6 includes an outer frame 12 made out of conductive material, an inner frame 14 also made out of conductive material, the first 12 and second 14 frames are electrically connected and connected to an electric-power source 16, forming the electric circuit 4.

The inner frame 14 includes an electric discontinuity. In the example shown, it includes a first portion 14.1 and a second portion 14.2 separated by a gap 15 filled either with air or with electrically insulating solid material.

The leaf 10 is pivotally mounted, in the example shown, on the sash-frame 6, but it could also be slidably mounted in the latter.

The leaf 10 includes at least one element 18 made out of electrically conductive material arranged so that it brings into electrical contact the first 14.1 and second 14.2 portions of the inner frame 14 when the leaf 10 is applied against the sash-frame 6.

Figure 2A:
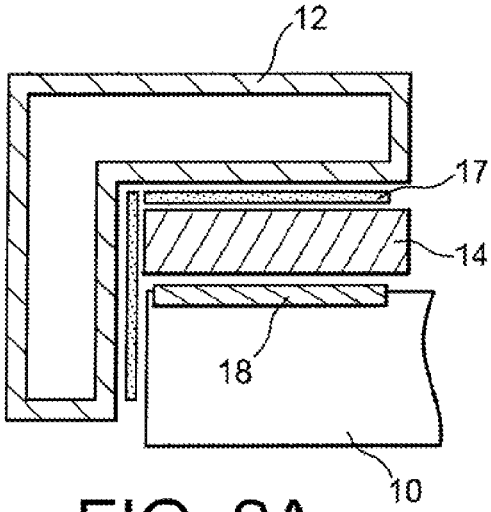
FIG. 2A is a cross-sectional view according to a horizontal plane, the door being in closed position.

In FIG. 2A, one can see the outer frame 12 and the inner frame 14 formed of profile bars. In the example shown, the outer frame 12 has an angle-shaped transversal cross-section and the inner frame has a rectangular transversal cross-section. An electrically insulating material 17 is interposed between the outer frame 12 and the inner frame 14.

In the example shown, the element 18 is formed by a plate mounted on the face of the leaf 10 aimed at entering into contact with the sash-frame 6.

Figure 2B:
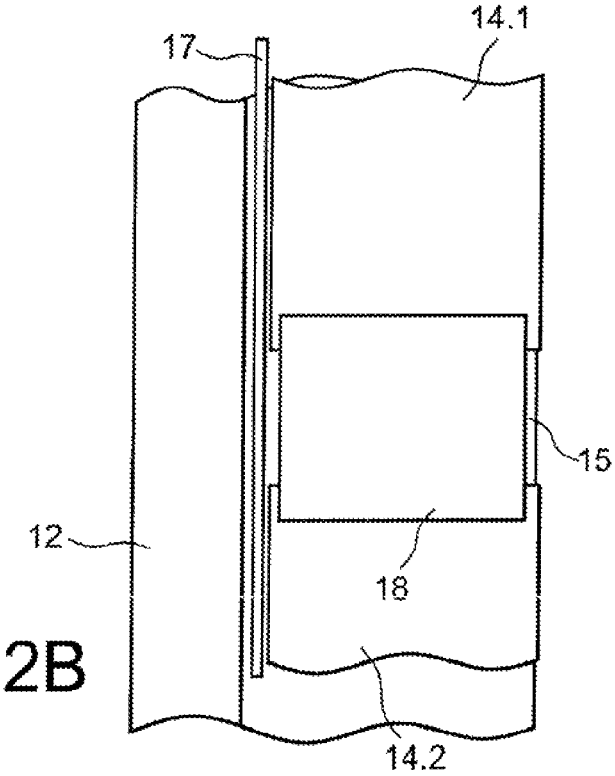
FIG. 2B is a detail view at the level of a central portion of the door and the sash-frame of the door, the door being in closed position, the leaf of the door being omitted.

In FIG. 2B, one can see the plate 18 electrically connecting the first 14.1 and the second 14.2 portions of the inner frame 14. In this configuration, the current flows through circuit 4 and the processing unit detects the closing of the door 2.

In the configuration of FIG. 1, the plate 18 does not electrically connect the first 14.1 and second 14.2 portions of the inner frame 14, the current does not flow through the electric circuit 4, the processing unit then detects the open position of door 2.

The present invention also applies to windows. In the case of windows with several leaves, in particular with two leaves, it is foreseen to be able to detect the opening of one and/or the other one of the leaves. In the example shown, the element carried by each leaf, and capable of opening the electric circuit when the leaf is closed, is arranged on the side of the window carrying the hinges. This element can also be arranged on one of the other portions of the sash-frame of the window.

Figure 6:
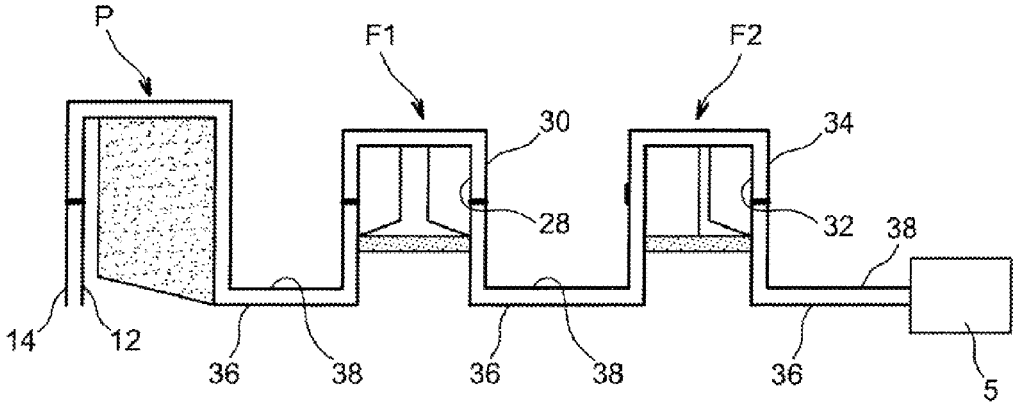
FIG. 6 is a schematic representation of an alarm system for doors and windows of a house.

It is thus possible to perform a monitoring of all or part of the openings of a house, such as schematically shown in FIG. 6, in which the inner 14 and outer 12 frames of a door P, the inner 28 and outer 30 frames of a first window F1, the inner 32 and outer 34 frames of a second window F2 are electrically connected in series through conductive plinths 36, 38 forming the extension of each of the inner 14, 28, 32 and outer 12, 30, 34 frames. In this configuration, one single open leaf closes the electric circuit connecting all the openings of the house and causes, for example, an alarm to be emitted. The reverse configuration, in which the opening of a leaf would cause the circuit to be opened can also be contemplated, in a way comparable to the device of FIG. 1.

The electrically conductive elements can, for example, be made out of plain conductive material or include a core or a layer of conductive material.

Figure 3:
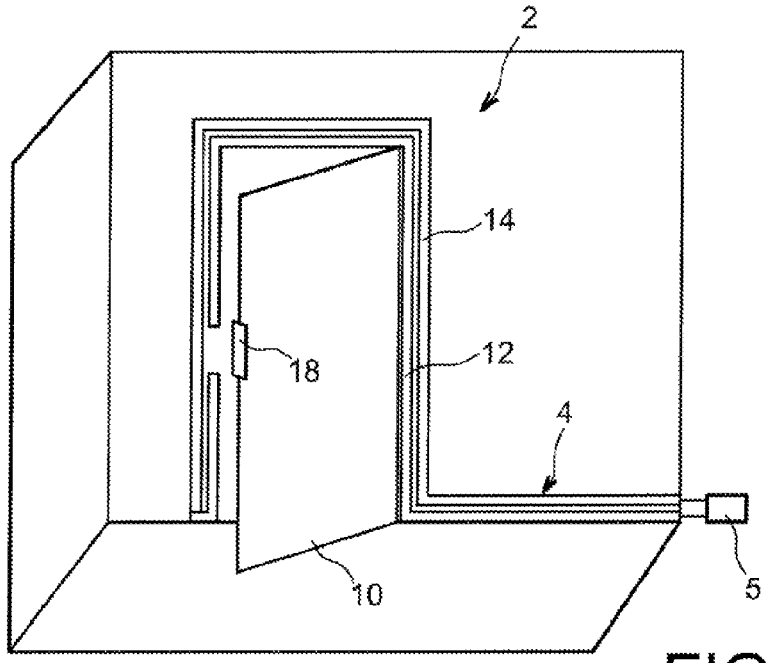
FIG. 3 is a schematic representation of another example of the detecting device applied to a door.

In FIG. 3, one can see another example of a door, wherein the plate 18 is placed on an edge 20 of the leaf 10; in this case, the inner frame 14 is arranged perpendicular to the faces of the leaf 10.

It can also be contemplated to use a bolt of the door to close the electric circuit 4.

It can be contemplated to open the electric circuit 4 when closing the door, instead of closing it. In such case, there can be provided for a keeper with a movable portion, this movable portion closing the electric circuit when the door is opened, and opening the circuit when closing the door, through the pressure of the bolt on the movable portion of the keeper.

In the exemplary embodiments described, the closing of the electric circuit occurs substantially at the level of a door handle (not shown), but the plate 18 as well as the discontinuity of the inner frame 14 can be provided at a different place, for example on a higher portion of the door or on the side of the hinges, so as to further improve the aesthetics of the door.

Figure 4A:
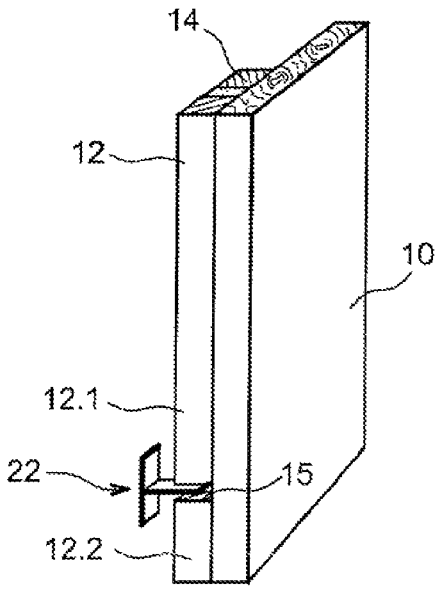
FIGS. 4A and 4B are perspective views of another exemplary embodiment of a detecting device according to the present invention in two different positions.
Figure 4B:
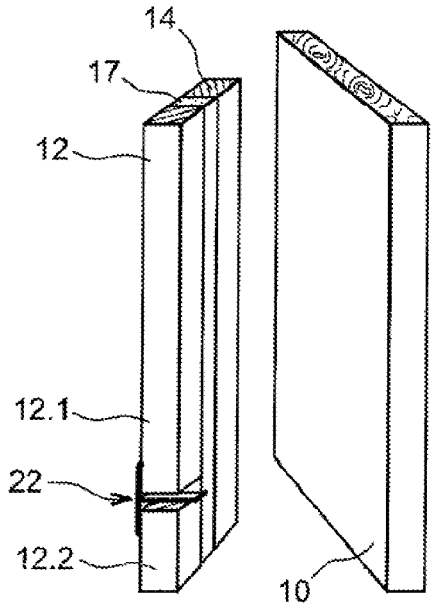

In FIGS. 4A and 4B, one can see another exemplary embodiment of a detecting device applied to a door, in this case, the opening or closing of the electric circuit is achieved through a movable conductive part in the sash-frame, the displacement of which is controlled by the leaf of the door.

The same reference numerals as those used for FIGS. 1 to 3 will be used for the description of FIGS. 4A and 4B.

In the example shown, the outer frame 12 is discontinuous and includes a first 12.1 and a second 12.2 portion separated by a non electrically conductive gap 15; the portions 12.1 and 12.2 are aimed at being brought into electrical contact by filling the gap 15 or bridging the gap 15 by means of an electrically conductive part.

A conductive part 22 is movably mounted in gap 15. It can for example be T-shaped, the two legs of the T 22.1, 22.2 entering respectively into contact with the portions 12.1, 12.2 and allowing the passing-through of the current.

The foot 22.3 of the T 22 is mounted in the gap 15 and is aimed at entering into contact with the leaf 10. The T 22 is elastically restored towards the outside of the outer frame 12, in the direction of the leaf 10.

Thus, when the door is open (FIG. 4B), the legs of the T electrically connecting the first 22.1 and the second 22.2 portions of the outer frame 12, causing the current to pass through the circuit, the processing unit detects the opening of the door.

When the door is closed (FIG. 4A), the leaf 10 is resting against the foot 22.3 of the T 22 and separates the branches 22.1, 22.2 from the first 12.1 and second 12.2 portions of the inner frame 12, respectively, which opens the electric circuit 4. The processing unit then detects the closing of the door.

In contrast to the exemplary embodiments of FIGS. 1 to 3, the current flows through the electric circuit when the door is open.

The detecting device can, for example, allow activating the illumination inside the room or the space closed by the door.

Figure 5:
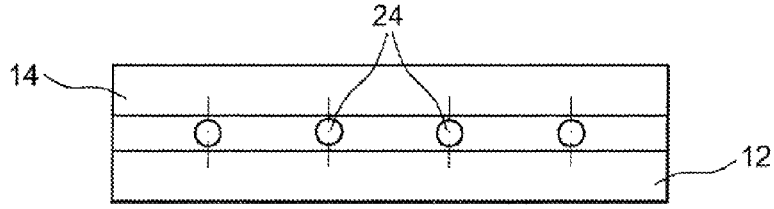
FIG. 5 is a detail view of a variant embodiment of a device provided with a sensor according to the present invention.

In FIG. 5, one can see lamps 24, of the LED type wired in parallel on the inner frame 14 and the outer frame 12, as shown in FIG. 5.

Thus, when the current flows through the electric circuit 4, the diodes 24 turn on.

Therefore, when the door is open, in the example of FIG. 4B, the diodes illuminate the interior of the space.

The detecting device according to the present invention can thus be integrated into a piece of furniture made of electrically conductive material, for example of aluminum, in order to illuminate the interior of the piece of furniture, when a user opens the door. When opening the leaf, the pressure on the movable part 22 is released, which then allows the current to circulate through the inner 14 and outer 12 frames and the diodes.

In the case of a sash-frame made according to FIG. 5, it can allow signaling an emergency exit.

It can be contemplated to have a monitoring installation for a house including several devices according to the present invention, wherein the detecting devices can all be identical or have different structures, for example a door or several doors can be provided with the device according to the second exemplary embodiment and the windows can be provided with the device according to the first exemplary embodiment.

Figure 7A:
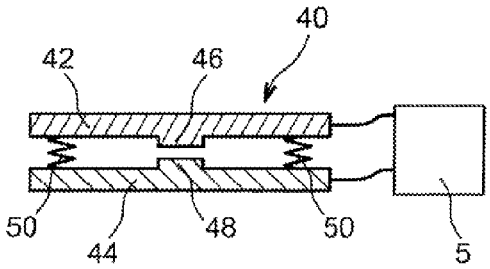
FIGS. 7A and 7B are schematic side representations of another embodiment of a detecting device according to the present invention.
Figure 7B:
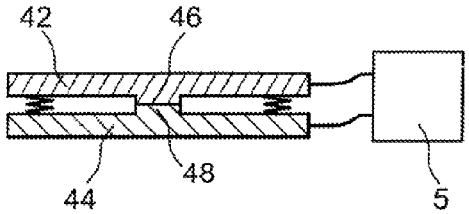

In FIGS. 7A and 7B, one can see another embodiment of a detecting device according to the present invention, namely adapted to the windows in the roofs, of the Velux® type.

This kind of window is provided with a leaf rotationally mounted about an axis passing substantially at the level of its median portion.

The opening of this kind of window occurs by pulling on a handle arranged along a post of the leaf, the displacement of this handle causes the displacement of the bolt with respect to the keeper, and the unlocking of the leaf with respect to the sash-frame.

This kind of window can be difficult to be handled, namely in the case of large-size windows. Indeed, because of the weight of the leaf, the latter can difficultly be retained by a person and is likely to be pulled by the opening motion. In addition, the closing of this kind of window requires lifting the leaf, which can also be problematic.

Therefore, there has been contemplated to assist the opening and the closing of Velux® by means of an electric motor, which, when actuating the handle, starts assisting the rotation in a direction of opening or closing the window. The motor can then exert a torque on the leaf at the level of its axis, or exert a pulling or pushing force on the leaf through a toothed-rack screw system mounted at an end of the leaf.

Usually, a device for detecting the displacement inserted against the leaf detects the displacement of the handle with respect to the leaf.

Thanks to the present invention, this detecting device is directly integrated into the handle and does not require any external detecting device.

It is then foreseen to manufacture a composite handle formed of electrically conductive parts, which are, in the rest position, separated from each other and which, when actuating the handle, enter into contact and close an electric circuit connected to a processing unit, which will send an activation signal to the electric motor.

In FIGS. 7A and 7B, one can see an exemplary embodiment of such a handle 40 including a first portion 42 and a second portion 44 substantially parallel and movable with respect to each other. The first portion 42 is fixed to the frame of the leaf (not shown), and the second portion 44 is mounted articulated, for example on the first portion or the sash-frame of the window.

Each portion 42, 44 has an elongated shape, and includes a protrusion 46, 48 substantially in its central portion, in front of the protrusions 48, 46 of the other portion 44, 42.

Both portions 42, 44 are connected to a processing unit 5.

The handle portions 42, 44 are elastically separated from each other by springy means 50. Thus, the portions are separated from each other and the electric circuit is opened without any effort opposing the efforts exerted by the springy means.

In the event of actuating the handle, the portions 42, 44 are brought close to each other, the protrusions 46, 48 enter into contact as shown in FIG. 7B, which causes the electric circuit to be closed and the passage of the current to be interrupted, which is detected by the processing unit 5. The processing unit 5 regards the closing of the circuit as a desire to open the window and sends an adequate signal to the electric motor or a current-supply source for the motor.

Thus, the actuation of the handle is detected without the use of an external detecting device, the handle itself is part of the detecting device. The system is then simplified and more esthetical.

The present invention can also apply to the opening of large-size doors, the manual displacement of which can be difficult, or to the opening of a cover plate or trunk of a motor vehicle.

The shape of both parts 42, 44 is not limited to the shape described, protrusions can for example be provided for at each end of the elongated body.

The handles, in the case of the Velux, are covered with an electrically insulating coating, such as paint. In addition, the circuit operates at low voltage. Thus, the users are not likely to be electrocuted.

This observation applies to any implementation of the invention in which electric protection of the users and/or the external environment is required.

Figure 8A:
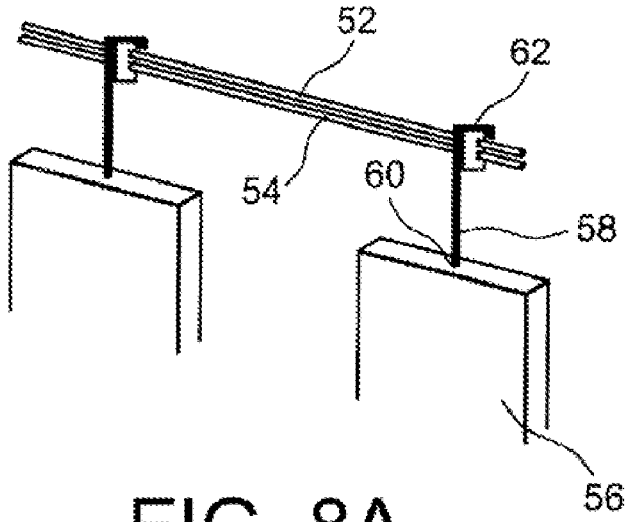
FIGS. 8A to 8C are schematic representations of a first exemplary embodiment of a third embodiment of a detecting device according to the present invention.
Figure 8B:
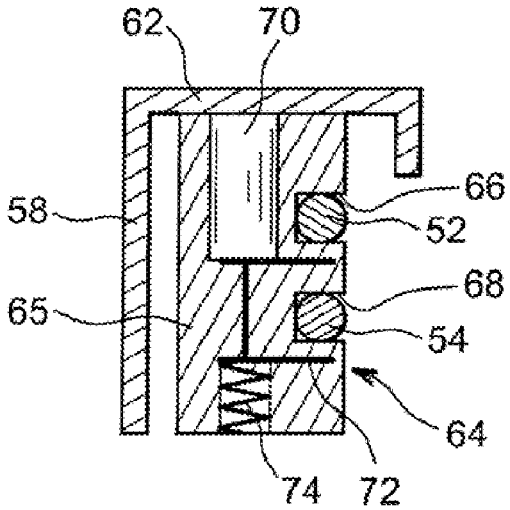
Figure 8C:
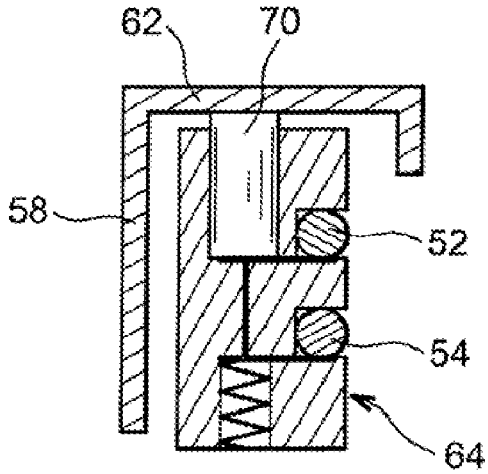
Figure 9A:
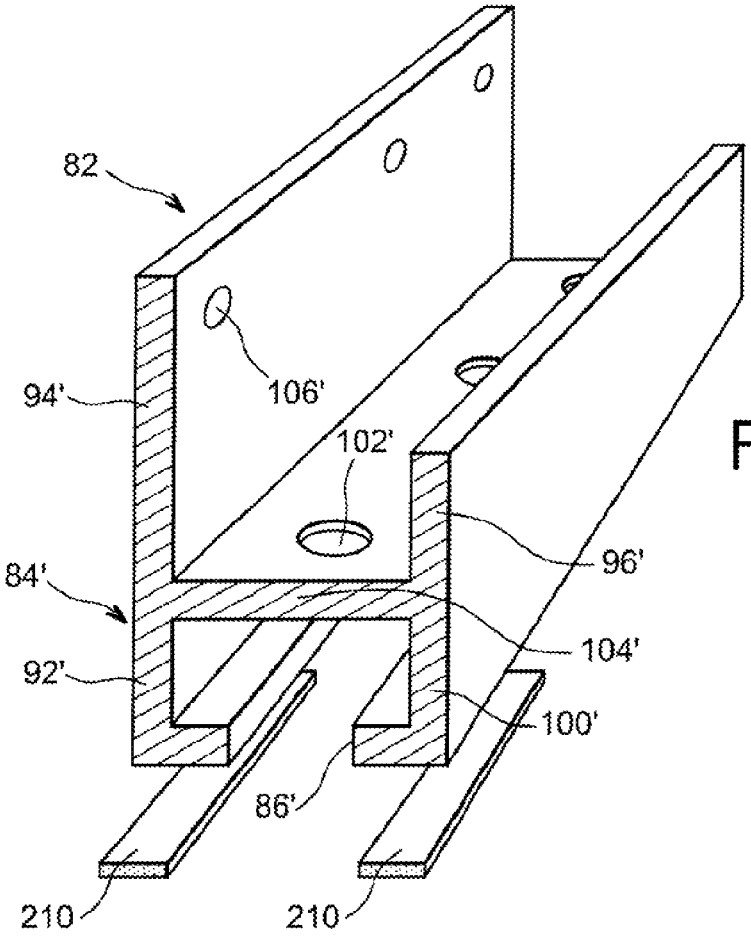
FIGS. 9A to 9C are perspective views of the various elements a detecting device according to a second exemplary embodiment of the third embodiment is comprised of, FIGS. 10A to 10C are cross-sectional representations of the detecting device of the FIGS. 9A to 9C.
Figure 9B:
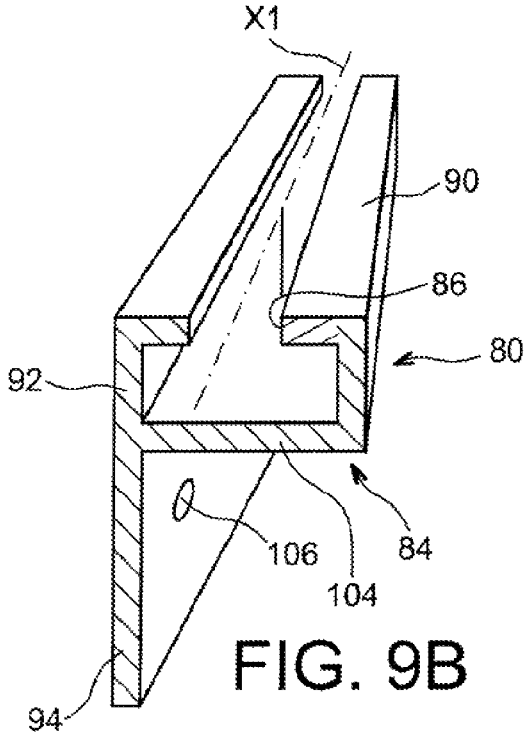
Figure 9C:
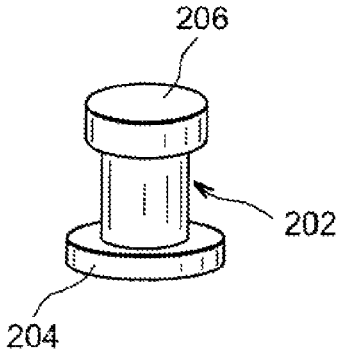

In FIGS. 8A to 8C, one can see a schematic representation of a first example of a third embodiment of a device for detecting a displacement according to the present invention applied to the monitoring of objects, namely paintings.

A painting can, for example, be fixed by a rod to a cable extending along a wall. This cable can extend all around the room and support several paintings.

According to the present invention, the detecting device includes two parallel electrically conductive parts 52, 54 aimed at supporting at least one painting 56, these electrically conductive parts 52, 54, for example of a cable type, are part of an electric circuit and are connected to a processing unit (not shown).

The painting 56 is coupled to the cables 52, 54 through a rod 58 fixed with a first end 60 to the painting 56 and with a second end 62 to the cables 52, 54. The second end 62 is in the form of a hook.

The detecting device according to the present invention also includes a contactor 64 interposed between the rod 58 and the cables 52, 54, this contactor 64 is movable with respect to the electrically conductive parts 52, 54.

The contactor 64 includes a body 65 provided, on one side, with two grooves 66, 68 each receiving a cable 52, 54, a stud 70 movable in the body 65 and a metallic electrically conductive element 72 aimed at electrically connecting the two cables 52, 54.

The electrically conductive element 72 is maintained into contact with the stud 70 by a spring 74.

In FIG. 8C, the stud 70 is, in resting position, protruding out of the body 65 under the action of the spring 74.

In FIG. 8B, a painting 56 is coupled to the cables, the hook 62 presses on the stud 70, which moves, the displacement of stud 70 results into the displacement of the element 72, which moves away from the cables 52, 54. The electric circuit is open.

If the painting 56 is removed, the stud 70, because of the force exerted by spring 74, moves towards the outside of the body 65, the electrically conductive element 72 enters into electrical contact with the two cables 52, 54 and closes the electric circuit. The current can then flow, the processing unit then sends a signal of absence of the painting.

All the paintings coupled to the cables 52, 54, can be provided with such a detecting device.

In FIGS. 9A to 9C and 10A to 10C, one can see a second exemplary embodiment of the third embodiment of a detecting device according to the present invention, wherein the cables 52, 54 are replaced by a cornice comprised of two electrically insulated profile bars made out of electrically conductive materials.

The detecting device according to the present invention includes a support 76 for coupling a painting 56 forming a cornice along a wall 78.

Said support is comprised of a lower element 80 and an upper element 82, such as metal profile bars arranged above each other, aimed at being fixed to the wall 78.

The lower element 80 includes a tube 84 with an axis X1, with a rectangular cross-section, including an axial groove 86 in one side 90 of the tube 84.

A side 92 orthogonal to the side 90 including the groove 86 is extended by a bearing plate 94, so as to form a base plate aimed at entering into flat contact with the wall 78.

The upper element 82 has substantially the same shape as the lower element 80. The reference numerals used to designate the portions of the element 80 will be used with the addition "'" to designate the similar portions of the upper element 82.

The upper element 82 is arranged on the lower element 80, so that the groove 86' is in front of the groove 86.

The upper element includes, parallel to the bearing plate 94', a plate 96' extending on one side 100' parallel to the side 921.

Holes 102' are provided for in a side 104' opposite the side 901 including the groove 86', in order to allow the passing-through of a finger 200.

The plates 94, 94' include holes 106, 106' for fixing the upper 82 and lower 80 elements to the wall 78.

A plunger 202 is movably mounted in the tube 84, orthogonally to its axis, and protrudes into the tube 84' through the grooves 86, 86'.

The plunger 202 capable of transporting the electrical current includes, at a lower end, a base plate 204 arranged in the tube 84 and, at an upper end, a probe 206 in the tube 84', in front of an opening 102', the probe 206 being aimed at entering into contact with the finger 200.

The plunger 202 is elastically restored in the direction of the opening 1021 by elastic means 208, of the helical-spring type mounted in reacting between a bottom of a bore provided for in the base plate 204 of the plunger 202 and the side 104.

The finger 200 forms the end of the coupling rod of the painting.

Two strips 210 of electrically insulating material are arranged along the grooves 86, 86' so as to insulate the two upper 82 and lower 80 elements.

We will now explain the operation of the detecting device.

Both profile bars 80, 82 as well as the plunger 202 are part of an electric circuit supplied by a processing unit (not shown).

Figure 10A:
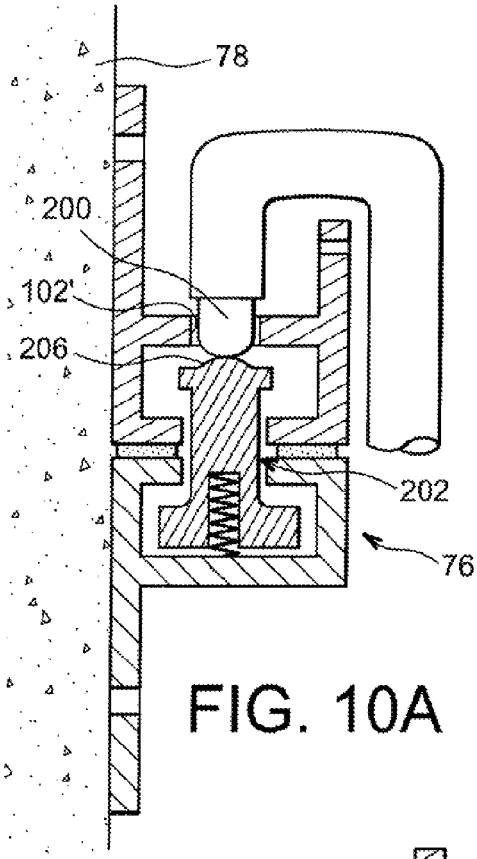

When a downward force is applied on the plunger 202 by the finger 200, as shown in FIG. 10A, which means that a load is applied on the coupling rod by a coupled painting 56, the plunger 202 is in the lower position, the electric circuit is then open. The processing unit then detects the presence of the painting.

Figure 10B:
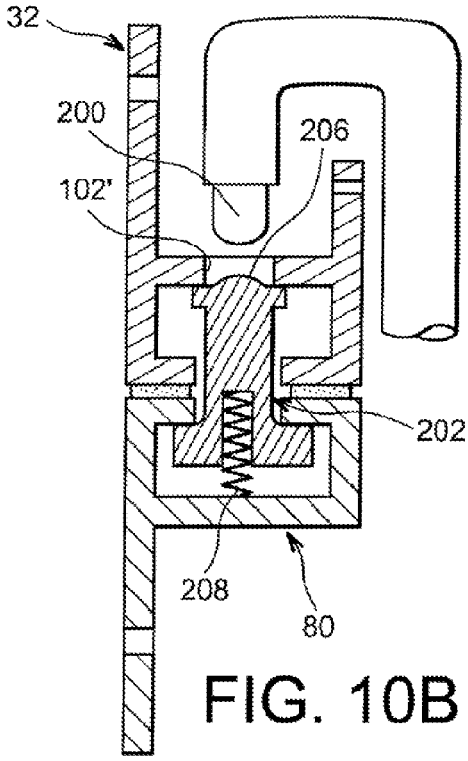

On the other hand, in the absence of the painting, as shown in FIG. 10B, no force is applied on the plunger 202 against the spring 208, the plunger 202 is then in the upper position, its base plate enters into contact with the edges of the groove 86 of the profile bar 80 and the probe 206 enters into contact with the contours of the opening 102'. The electric circuit is then closed, the processing unit deduces the absence of the painting and then generates an alarm.

The profile bars 80, 82 are aimed at extending along a wall or several walls of a room, in order to support several paintings. In the upper profile bar 82 are then provided openings at the locations where one wants to couple the paintings.

It can also be contemplated to use a support 76 for one single painting.

Figure 10C:
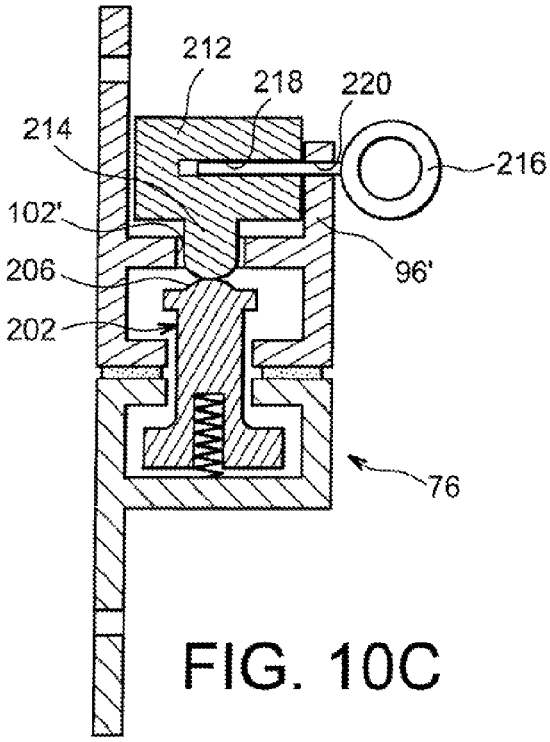

The devices for detecting of presence of the paintings are electrically connected in series. Thus, in the absence of a painting, the processing unit will send an alarm, while this absence can be due to the desire not to couple a painting at that location. There is then advantageously provided for a device for exerting a force on the plunger so as to maintain it in the lower position, an exemplary embodiment of which is shown in FIG. 10C.

The latter is comprised, in the example shown, of a body 212 provided with a protruding stud 214, with a shape and size similar to those of the finger 200 of the coupling rod and a pin 216 aimed at penetrating into a bore 218 provided for in the body 212 and a passageway 220 provided for in the plate 96'.

The stud 214 is then maintained applied against the probe 206 by mounting the pin 216 in the bore 218 and the passageway 220.

This device thus constitutes a decoy for the detecting device.

It can be advantageous to foresee that the rod 58 is integral with the painting 56.

The devices implementing the present invention advantageously operate at low voltage, for example lower than 5V and a current intensity ranging from 1 μA and a few amperes.

What is claimed:

1. Device for detecting a relative position of a first element having a main mechanical function, with respect to a second element, this device comprising:

a first element and a second element, wherein the first element is a sash-frame of a door or window, while the second element is a leaf of the door or window, wherein the first element includes two electrically conductive portions isolated from each other, wherein each of the electrically conductive portions is made of an electrically conductive material and has a mechanical support function in a construction of the sash-frame of the door or window, an electrically conductive movable part, wherein the electrically conductive movable part moves between a first position in contact with both electrically conductive portions of the first element and a second position without contact with at least one of the two electrically conductive portions when the door or window is moved, wherein the two electrically conductive portions and the electrically conductive movable part form an electric circuit section, an opening and closing of which respectively correspond to a first and a second position of the first and second elements with respect to each other, wherein the sash-frame of the door or window includes an electrically conductive outer frame and an electrically conductive inner frame, said outer and inner frames constituting said electrically conductive portions, wherein an electric discontinuity is provided in at least one of the frames, and wherein the electrically conductive movable part is capable of bridging the discontinuity in order to close the electric circuit section, said movable part being either carried by the leaf or arranged in the discontinuity and bringing into contact said electrically conductive portions on both sides of the discontinuity when nearing or separating the leaf.

2. Device according to claim 1, wherein:

the movable electrically conductive part is T-shaped, arms of the T are aimed at entering, each, into contact with the electrically conductive portions on both sides of the discontinuity and a foot of the T acts as actuation means aimed at entering into contact with the leaf, the closing of the door or window causing the legs of the T to separate from the electrically conductive portions on both sides of the discontinuity.

3. Device according to claim 2, wherein diode-type illumination means, capable of being lighted when the electric circuit is closed, are mounted between the inner frame and the outer frame.

4. Device according to claim 1, wherein the movable electrically conductive part is formed by a movable keeper capable of being moved by a bolt.

5. Device according to claim 4, wherein diode-type illumination means, capable of being lighted when the electric circuit is closed, are mounted between the inner frame and the outer frame.

6. Device according to claim 1, wherein the sash-frame of the door or window includes an electrically conductive outer frame and an electrically conductive inner frame isolated from each other, said outer and inner frames constituting said electrically conductive parts portions, and wherein the movable part capable of bringing the outer and inner frames into electrical contact, said movable part being moved by the leaf.

7. Device according to claim 6, wherein diode-type illumination means, capable of being lighted when the electric circuit is closed, are mounted between the inner frame and the outer frame.

8. Monitoring installation including several detecting devices according to claim 6 wherein the electric circuit sections of the devices are electrically connected in series in an electric circuit of the installation.

9. Device according to claim 6, wherein the electrically conductive outer frame and the electrically conductive inner frame are connected electrically to an electric-power source so as to form an electric circuit.

10. Device according to claim 9, wherein the inner frame and the outer frame are connected to the electric circuit in a first location, and the movable part is located in a second location which is remote from the first location along the frame.

11. Device according to claim 9, wherein the inner frame and the outer frame are connected to the electric circuit on a side of hinges of the door or window, and the movable part is located on a side of a handle of the door or window or on a side of a higher portion of the door or window.

12. Device according to claim 11, wherein the inner frame and the outer frame are connected electrically to the electric-power source through conductive plinths forming an extension of the inner frame and the outer frame from the first location.

13. Device according to claim 1, wherein diode-type illumination means, capable of being lighted when the electric circuit is closed, are mounted between the inner frame and the outer frame.

14. Monitoring installation including several detecting devices according to claim 1 wherein the electric circuit sections of the devices are electrically connected in series in an electric circuit of the installation.

15. Monitoring installation including several detecting devices according to claim 1, wherein the electric circuit sections of the devices are electrically connected in series in an electric circuit of the installation.

16. Device according to claim 1, wherein the electrically conductive outer frame and the electrically conductive inner frame are connected electrically to an electric-power source so as to form an electric circuit.

17. Device according to claim 16, wherein the inner frame and the outer frame are connected to the electric circuit in a first location, and the electric discontinuity is located in a second location which is remote from the first location along the frame.

18. Device according to claim 16, wherein the inner frame and the outer frame are connected to the electric circuit on a side of hinges of the door or window, and the electric discontinuity is located on a side of a handle of the door or window or on a side of a higher portion of the door or window.

19. Device according to claim 18, wherein the inner frame and the outer frame are connected electrically to the electric-power source through conductive plinths forming an extension of the inner frame and the outer frame from the first location.

* * * * *